United States Patent [19]

Schips

[11] Patent Number: 5,054,409

[45] Date of Patent: Oct. 8, 1991

[54] APPARATUS FOR LATERALLY ALIGNING A FABRIC EDGE DURING SEWING

[76] Inventor: Helmut Schips, Klosterweidlistr. 1, CH-9010 St. Gallen, Switzerland

[21] Appl. No.: 479,290

[22] Filed: Feb. 13, 1990

[30] Foreign Application Priority Data

Feb. 14, 1989 [DE] Fed. Rep. of Germany ..... 3904385

[51] Int. Cl.[5] ..... D05B 21/00; D05B 27/14

[52] U.S. Cl. ..... 112/306; 112/320; 112/153; 112/262.3

[58] Field of Search ..... 112/80.31, 90, 121.11, 112/121.12, 146, 153, 220, 262.3, 272, 304, 308, 306, 309, 313, 320, 322; 271/10, 246, 250, 254, 258

[56] References Cited

U.S. PATENT DOCUMENTS

| | | | |
|---|---|---|---|
| 4,109,596 | 8/1978 | Blessing | 112/121.11 |
| 4,191,118 | 3/1980 | Blessing | 112/153 X |
| 4,200,049 | 4/1980 | Blessing | 112/262.3 |
| 4,434,729 | 3/1984 | Davidson | 112/320 X |
| 4,813,364 | 3/1989 | Boser | 112/153 X |
| 4,836,119 | 6/1989 | Siraco et al. | 112/306 |

*Primary Examiner*—Werner H. Schroeder
*Assistant Examiner*—Ismael Izaguirre
*Attorney, Agent, or Firm*—Hubbard, Thurman, Tucker & Harris

[57] ABSTRACT

For laterally aligning a fabric web edge during sewing with a sewing machine (4, 6), a guide means (2) is used which can be moved perpendicularly to the conveying direction of the fabric web (S) in order to gently press the fabric web against an abutment (16) which is designed, for instance, as a driven roller and is capable of producing a variable counter-pressure. The guide means contains a ball chain (18) guided about two chain wheels. The balls are supported on a plastic rope so as to be able to rotate together with the fabric web being conveyed. By rotating the chain wheels, the lower length of the chain (18) and, thus, the fabric web (S) can be shifted laterally so as to obtain the desired aligning effect.

19 Claims, 1 Drawing Sheet

FIG. 1
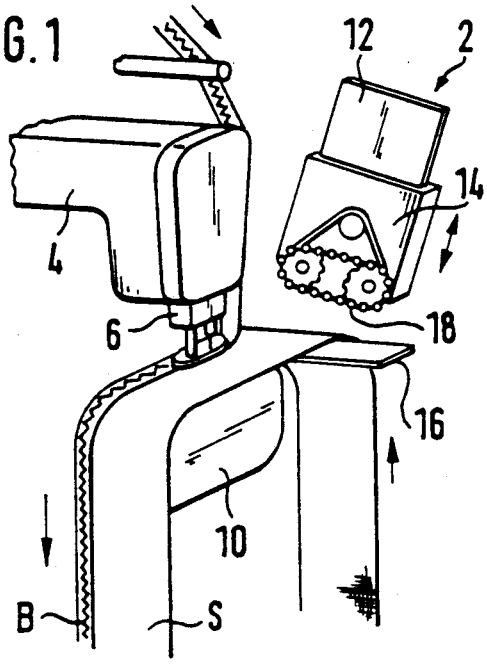
FIG. 2
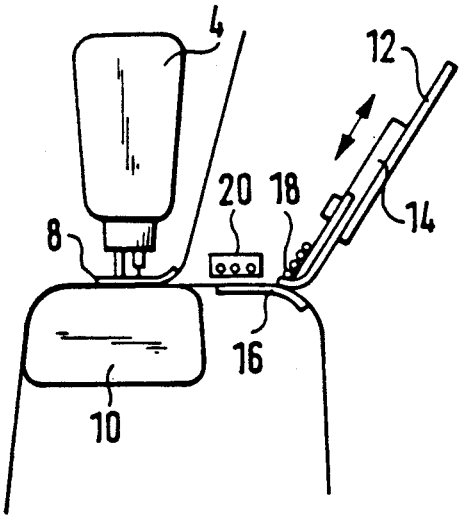
FIG. 3
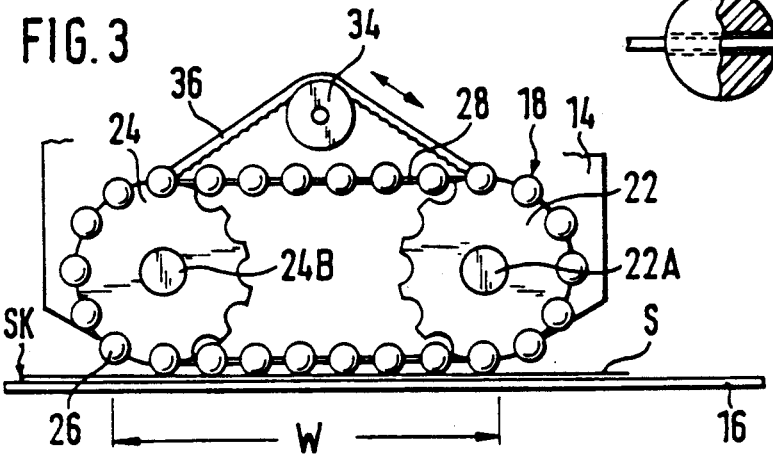
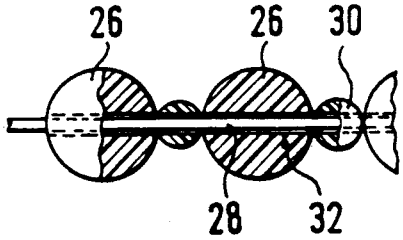
FIG. 4
FIG. 5
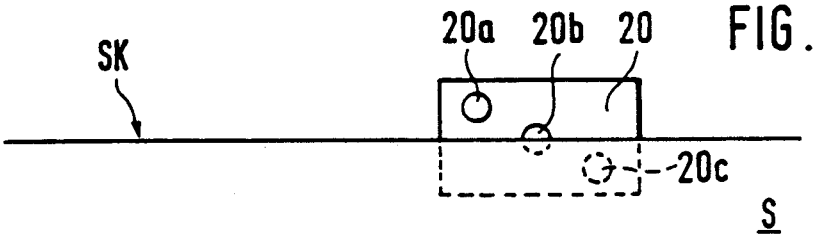

APPARATUS FOR LATERALLY ALIGNING A FABRIC EDGE DURING SEWING

BACKGROUND OF THE INVENTION

The invention relates to an apparatus for laterally aligning one fabric edge or two fabric edges during sewing, and more particularly to apparatus for detecting the lateral position of the fabric edge transversely of the sewing direction and generating a sensor signal, and which includes a guide mechanism controlled by the sensor signal for laterally aligning the fabric edge during sewing.

Especially with industrial automatic sewing machines, in particular machines for contour sewing, it is important to have available an auxiliary means at high working speeds which takes care in partly or completely automatic manner that the fabric edge assumes the prescribed lateral position in quite exact fashion. It is conceivable to keep the fabric on a prescribed path by means of stopper devices. However, this is an insufficient auxiliary means because, especially in case of different curves, the fabric may fold at the lateral stop and thus no longer takes the desired position during conveyance thereof.

It is also conceivable to pass the fabric between a pressing plate and a wheel in order to adjust the wheel in response to a fabric edge sensor signal in such a manner that the fabric edge takes the desired position. However, such a way of guiding presents a problem in that the fabric must be fed to the sewing head with as little tension as possible and that the application of a wheel would distort the fabric. German patent DD-132 508 (corresponding to published application DE 28 22 634 Al) shows such a possibility in which the fabric slides axially past the circumference of the wheel. For reducing this friction, French FR-2 585 378 shows a wheel having rolling discs distributed across the circumference thereof. However, here too only a particular point of the wheel abuts the fabric so that undesired distortions may result in the fabric.

Therefore, it is an object of the invention to provide an apparatus for laterally aligning a fabric edge during sewing, that permits exact alignment of the edge while presenting virtually no resistance to the fabric conveying motion effected by the sewing machine, and that leaves the fabric virtually without any tension.

SUMMARY OF THE INVENTION

The position of the fabric edge during sewing is detected by a sensor assembly. A sensor signal produced by the sensor assembly is evaluated as a control signal in order to thereby adjust the fabric web and thus the fabric edge in such a manner that it assumes the desired position. The adjustment of the fabric web or piece and the fabric edge to the desired position and holding of the fabric web in the proper position, respectively, is effected by means of the controlled guiding means. A chain according to the present invention, is equipped with ball-like or spherical rolling members and presses the fabric web against a suitable basis, such as the fabric supporting plate or an extension of the fabric supporting plate. The ball-like or spherical configuration of the rolling members of the chain permits a certain amount of lateral play with respect to the sewing direction. But, the fabric web is at the same time kept on its conveying path or adjusted to its conveying path, respectively. This occurs because the rolling axes extend perpendicularly to the conveying direction of the fabric web, i.e. parallel to the direction of adjustment. Due to the fact that several rolling members abut the fabric web simultaneously, safe guidance of the fabric web is ensured on the one hand and on the other hand the fabric web is held to the base with gentle pressure thereagainst, so that distortions of the fabric caused by tension can be excluded.

A specific feature of the invention is the design of the rolling members as balls that are lined up on a plastic or steel rope with a slight spacing from each other. The balls may have a surface nature, i.e. a specific surface roughness, suitable for the fabrics to be processed, so as to ensure on the one hand the desired guiding effect of the rollers moving together with the fabric web being conveyed, but to admit on the other hand also a certain amount of slippage between the balls and the fabric web so as to avoid distortion of the fabric web. The arrangement of the chain on two chain wheels whose axes of rotation extend approximately parallel to the fabric conveying direction and approximately perpendicularly to the rolling axes permits simple adjustment of the chain and thus simple adjustment of the fabric web transversely of the sewing direction. The adjustment mechanism preferably contains an electric servomotor that is driven by the sensor signal or a signal depending on the sensor signal. The servomotor is coupled to the chain wheels via a drive wheel and a driving belt, for instance a toothed belt.

The abutting effect on the fabric web has substantially no effect on the advancing motion of the fabric, and efficiency is generally achieved when at least five, but preferably ten or more balls abut the fabric web. Each of the balls has a diameter of approximately 5 mm, and the balls are lined up on the endless rope with a small spacing from each other so that they abut the fabric web at many locations.

BRIEF DESCRIPTION OF THE DRAWINGS

The invention may be more fully understood by reference to the following description of the preferred embodiment in conjunction with the drawings and wherein:

FIG. 1 is a perspective view of a part of an automatic sewing machine comprising the apparatus of the preferred guide means according to the present invention for laterally aligning a fabric edge during sewing;

FIG. 2 is a side view of the automatic sewing machine according to FIG. 1, in which the apparatus of the preferred guide means according to the present invention for laterally aligning the fabric web is lowered onto the fabric web;

FIG. 3 is an enlarged front view of the mechanism of the preferred guide means shown in FIG. 1 for laterally aligning the fabric web;

FIG. 4 is a fragmentary view, partly in section, of a chain contained in the mechanism of the preferred guide means shown in FIG. 3; and FIG. 5 is a schematic view of a sensor assembly for detecting the position of a fabric web.

DETAILED DESCRIPTION

An automatic sewing machine 4 shown in part in FIG. 1 serves for sewing an ornamental border B to a fabric web or piece S. The outer edge of the border B is to register exactly with the outer edge of the fabric web S. The border is laterally guides in an exact manner by suitable guide means.

The sewing machine 4 has a sewing head 6 which carries a fabric presser foot 8 through which the border B is pressed against the fabric web S, as can be seen from FIG. 2. During sewing, a portion of the fabric web abuts on a fabric supporting part 10 of the automatic sewing machine.

In the direction upstream of the conveying direction of the fabric web S as indicated by the arrows in FIG. 1, a guide means 2 is disposed in front of the sewing head 6 for laterally aligning the fabric edge of the fabric web S with the sewing head 6 or the sewing needle. The guide means includes a housing 14 attached to a support 12 so as to be slidable in the direction of the double arrow. The housing 14 can be urged downwardly against the fabric web S, the latter then being located on an abutment 16 having a configuration in accordance with the nature of the fabric web S. In this context, a driven roller is preferable as abutment 16. However, the abutment may also be designed as a plate, bow or the like. The counter-pressure applied by the abutment is adjustable.

The pressing-on is effected with the aid of a chain 18 as indicated in FIG. 2.

FIG. 4 shows the mechanism of the guide means 2 in detail. The housing 14 carries, on rotational axes 22A and 24A, two chain wheels 22 and 24, respectively, about which the chain 18 is guided. The lower length of the chain 18 defines a linear fabric abutting section W having a plurality of balls, numbering ten in the Figure, attached to the chain 18 that abut on the outside of the fabric web S. By rotating the chain wheels 22 and 24, the balls 26 in the fabric abutting section W are displaced, with the consequence that the fabric web S, and especially the fabric edge SK thereof is laterally moved along. In FIG. 3, alignment of the fabric web S moving out of the drawing plane is effected to the left or to the right, in order for the fabric edge SK to take its desired position.

For doing so, the actual position of the fabric edge SK must be determined first. This is achieved by means of a sensor assembly 20 which is merely outlined in FIG. 2 and shown in schematic detail in FIG. 5. The sensor assembly 20 may comprise three light barrier elements **20*a*, 20*b*, and 20*c* in the region of the fabric edge SK of the fabric web S. The sensor elements 20*a*, 20*b*, and 20*c* are laterally staggered with respect to the conveying direction (arrow), and the output signals thereof provide a sensor signal which can be processed further in a circuit provided by a person having average skill in the art so as to obtain a control signal controlling the adjustment of the chain 18**.

As can be seen from FIG. 3, the apparatus includes an adjustment mechanism. The adjustment mechanism includes a drive wheel 34 rotatably mounted above the chain wheels 22 and 24, and a toothed belt 36 guided about the drive wheel 34 and about the rear lugs of the chain wheels 22 and 24. When the drive wheel 34 is rotated leftwardly or rightwardly by an electric servomotor, not shown in the figures, but also included in the adjustment mechanism, the chain wheels 22 and 24 are thus rotated via the toothed belt 36, with the result that the chain 18 is adjusted. This leads in particular to a movement of the balls 26 in the fabric abutting section W. As a consequence thereof, the moving fabric web S is displaced laterally.

FIG. 4 shows a portion of the chain 18 in detail. A plastic rope having a certain elasticity (e.g. an aramide rope) has a multiplicity of preferably plastic balls lined up thereon. Each of the plastic balls 26 has a central bore, and the balls are lined up on the plastics rope 28 in an alternating manner with spacer balls 30, which preferably are also of a plastic material. The through-bores 32 of the balls 26 define rolling axes for the balls 26 and are dimensioned such that the balls 26 can rotate with very low frictional resistance.

The surfaces of the balls 26 may be somewhat roughened in order to obtain an optimum coefficient of friction between the ball surfaces and the fabric web or piece S.

Instead of the balls 26, it is also possible to provide other ball-like rolling members, for instance roller-like members or the like. It is important that no sharp edges abut the fabric web S, because otherwise the fabric web S could be distorted by lateral movement of the chain 18.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. An apparatus for laterally aligning fabric edges during sewing of a fabric web being conveyed through a sewing head of a sewing machine in a sewing direction and having an edge laterally spaced from the sewing direction, comprising:

a sensor assembly for detecting a lateral position of the fabric edge transversely of the sewing direction and generating a sensor signal; and a guide means controlled by the sensor signal, said guide means having:

a chain of rolling members disposed in a plane extending approximately transversely of the sewing direction, said chain being adjustable in response to the sensor signal, said rolling members having rolling axes extending parallel to a direction of adjustment, and said chain having a fabric abutting section containing a plurality of said rolling members disposed for simultaneous contact with a fabric web in the fabric plane to thereby control the lateral position of the fabric web with respect to the sewing head without distortion of the fabric.

2. The apparatus according to claim 1, wherein said rolling members are balls.

3. The apparatus according to claim 1, wherein said chain comprises a plastic or steel rope having lined up thereon a multiplicity of said rolling members, each rolling member having a central through-bore.

4. The apparatus according to claim 1, wherein said guide means further includes a pair of chain wheels, said chain being guided about said chain wheels, said chain wheels having axes of rotation extending approximately parallel to the sewing direction and approximately perpendicularly to rolling axes of the rolling members, and wherein at least one of the chain wheels is coupled with an adjustment mechanism for adjusting said at least one of the chain wheels and thus the chain by amounts generated by the sensor signal.

5. The apparatus according to claim 4, wherein said adjustment mechanism further comprises an electric servomotor coupled to the chain wheels via a drive wheel and a driving belt.

6. The apparatus according to claim 1, wherein the apparatus is adapted for use with a sewing machine having means for contour sewing, and wherein said guide means is disposed upstream of a conveying direction of the fabric web and upstream of the sewing head.

7. The apparatus according to claim 1, wherein said guide means includes a support for moving said guide means towards and away from the fabric web.

8. The apparatus according to claim 1, wherein said fabric abutting section comprises at least five rolling members.

9. The apparatus according to claim 1, wherein said rolling elements are balls, having a diameter between 4 and 10 mm.

10. The apparatus according to claim 9 wherein said balls are plastic balls.

11. The apparatus according to claim 1, wherein said sensor assembly comprises at least two sensor elements.

12. The apparatus of claim 11, wherein said sensor assembly comprises three sensor elements.

13. The apparatus of claim 11, wherein said sensor elements are light barriers, said sensor elements being disposed laterally with respect to the sewing direction in the region of the fabric edge.

14. The apparatus according to claim 1, wherein said rolling elements work in cooperation with an abutment in accordance with the characteristics of the fabric web.

15. The apparatus according to claim 14, wherein said abutment is a driven roller.

16. The apparatus according to claim 14, wherein said abutment includes a variable counter-pressure element.

17. The apparatus of claim 14, wherein said abutment has a curved surface.

18. The apparatus of claim 14, wherein said abutment is a plate.

19. The apparatus according to claim 1, wherein said rolling elements are balls having a diameter between 5 and 7 mm.

* * * * *